US009355626B2

(12) United States Patent
Kushner

(10) Patent No.: US 9,355,626 B2
(45) Date of Patent: May 31, 2016

(54) MUSICAL INSTRUMENT CASE WITH PROTECTIVE BOOT

(75) Inventor: Daniel Watson Kushner, San Rafael, CA (US)

(73) Assignee: Mono Creators Inc., Larkspur, CA (US)

( * ) Notice: Subject to any disclaimer, the term of this patent is extended or adjusted under 35 U.S.C. 154(b) by 684 days.

(21) Appl. No.: 13/612,317

(22) Filed: Sep. 12, 2012

(65) Prior Publication Data

US 2014/0131236 A1 May 15, 2014

Related U.S. Application Data

(60) Provisional application No. 61/557,896, filed on Nov. 9, 2011, provisional application No. 61/587,896, filed on Jan. 18, 2012, provisional application No. 61/587,363, filed on Jan. 17, 2012.

(51) Int. Cl.

| | |
|---|---|
| ***A45C 13/00*** | (2006.01) |
| ***G10G 7/00*** | (2006.01) |
| ***A45C 13/36*** | (2006.01) |
| *A45C 13/10* | (2006.01) |

(52) U.S. Cl.

CPC ..... *G10G 7/005* (2013.01); *A45C 13/36* (2013.01); *A45C 13/103* (2013.01)

(58) Field of Classification Search

USPC ..... 206/314, 14

See application file for complete search history.

(56) References Cited

U.S. PATENT DOCUMENTS

| | | | | | |
|---|---|---|---|---|---|
| 467,724 | A | * | 1/1892 | Kleineick | 206/14 |
| 712,357 | A | * | 10/1902 | Brey | 206/14 |
| 1,424,317 | A | * | 8/1922 | Nesser | 206/315.8 |
| 1,612,741 | A | * | 12/1926 | Newman-Butler | 224/613 |
| 1,737,967 | A | * | 12/1929 | Hall | 206/315.5 |
| 1,744,939 | A | * | 1/1930 | Wengard | 206/315.5 |
| 1,811,296 | A | * | 6/1931 | Boden et al. | 248/96 |
| 2,094,186 | A | | 9/1937 | Patrick | 206/315.4 |
| 2,867,257 | A | * | 1/1959 | Cart | 206/315.3 |
| 3,000,417 | A | | 9/1961 | Goldstein | 206/5 |
| 3,530,919 | A | | 9/1970 | May | 206/315.4 |

(Continued)

FOREIGN PATENT DOCUMENTS

| | | |
|---|---|---|
| DE | 20114494 U1 | 2/2002 |
| GB | 2169586 | 7/1986 |
| JP | 2002366143 A | 12/2002 |

OTHER PUBLICATIONS

PCT Application PCT/US12/00548, Preliminary Examination Report, Etc., mailed Mar. 6, 2014; 11 pages total.

(Continued)

*Primary Examiner* — Jacob K Ackun

(74) *Attorney, Agent, or Firm* — The Patent Source

(57) ABSTRACT

Cases for the protection of musical instruments each with a neck and a body are disclosed. The case includes a case body having an elongated upper portion for receiving the instrument neck and a lower enveloping portion with a far end for receiving the instrument body. The cases also include a selectively releasable cover hingedly affixed to the case body to permit selective access to the case body so that the instrument may be inserted into and removed from the case. The cases also include a protective boot attached to the far end of the case body. Optionally, such boots may include a central region disposed between a pair of opposing regions wherein the central region transfers less shock to the stringed instrument body than the opposing regions.

6 Claims, 12 Drawing Sheets

(56) References Cited

U.S. PATENT DOCUMENTS

| | | | | | |
|---|---|---|---|---|---|
| 3,877,501 | A | | 4/1975 | Toth | 150/52 |
| 3,901,299 | A | * | 8/1975 | Picco | 206/315.4 |
| 3,901,384 | A | | 8/1975 | Lee et al. | 206/314 |
| 4,065,995 | A | | 1/1978 | Greer | 84/465 |
| 4,190,152 | A | | 2/1980 | Reiter | 206/314 |
| 4,531,632 | A | | 7/1985 | Weber | 206/14 |
| 4,659,000 | A | | 4/1987 | Sales et al. | 224/252 |
| 4,738,340 | A | | 4/1988 | Crespi | 190/18 |
| 4,778,136 | A | | 10/1988 | Reimers | 248/96 |
| 4,795,030 | A | | 1/1989 | Boyce | 206/314 |
| 4,846,340 | A | | 7/1989 | Walther | 206/14 |
| 5,441,134 | A | | 8/1995 | Carson | 190/111 |
| 5,515,897 | A | * | 5/1996 | Fehan | 150/159 |
| 5,632,496 | A | * | 5/1997 | Nelson | 280/30 |
| 5,653,318 | A | * | 8/1997 | Field | 190/18 R |
| 5,669,495 | A | * | 9/1997 | West | 206/317 |
| 5,833,051 | A | | 11/1998 | Tiefenbrun et al. | 206/14 |
| 5,875,890 | A | * | 3/1999 | Di Bernardini | 206/314 |
| 6,000,509 | A | | 12/1999 | Chisholm | 190/109 |
| 6,029,804 | A | | 2/2000 | Flynn | 206/14 |
| 6,062,383 | A | * | 5/2000 | Han | 206/315.7 |
| 6,126,012 | A | | 10/2000 | Roegner | 206/579 |
| 6,148,999 | A | * | 11/2000 | Olson | 206/315.4 |
| 6,172,292 | B1 | | 1/2001 | Dimbath | 84/453 |
| 6,247,588 | B1 | * | 6/2001 | McCreary | 206/315.4 |
| 6,283,287 | B1 | | 9/2001 | Carl | 206/314 |
| 6,441,288 | B1 | | 8/2002 | Lin | 84/453 |
| 6,462,260 | B2 | | 10/2002 | Fediakov | 84/327 |
| 6,499,592 | B2 | | 12/2002 | Wilfer | 206/314 |
| 6,505,762 | B2 | | 1/2003 | Wilfer | 224/153 |
| 6,670,536 | B2 | | 12/2003 | Godin et al. | 84/453 |
| D487,627 | S | | 3/2004 | Izen et al. | D3/204 |
| 6,727,415 | B1 | | 4/2004 | Herring | 84/411 |
| 6,951,280 | B1 | * | 10/2005 | Lee | 206/314 |
| 6,959,810 | B2 | | 11/2005 | Neilson | 206/314 |
| 7,044,298 | B1 | * | 5/2006 | Pryst | 206/315.3 |
| 7,188,714 | B1 | * | 3/2007 | Herold | 190/18 A |
| 7,208,666 | B2 | | 4/2007 | Burch | 84/327 |
| 7,687,701 | B1 | | 3/2010 | Kushner | 84/453 |
| 7,712,608 | B2 | | 5/2010 | Leach | 206/314 |
| 8,141,703 | B2 | * | 3/2012 | Sonoda et al. | 206/314 |
| 8,212,134 | B2 | | 7/2012 | Kushner | 84/453 |
| 2003/0066770 | A1 | | 4/2003 | Heesch | 206/314 |
| 2005/0056510 | A1 | * | 3/2005 | Hsieh | 190/18 A |
| 2006/0230905 | A1 | | 10/2006 | Stanley | 84/328 |
| 2007/0151879 | A1 | * | 7/2007 | Chow | 206/315.3 |
| 2007/0204742 | A1 | | 9/2007 | Wilkerson | 84/329 |
| 2008/0060956 | A1 | | 3/2008 | Izen et al. | 206/314 |
| 2008/0264745 | A1 | | 10/2008 | Tauchen | 190/111 |
| 2010/0059409 | A1 | | 3/2010 | Crowder | 206/757 |
| 2010/0252464 | A1 | | 10/2010 | Belitz | 206/314 |
| 2011/0203952 | A1 | | 8/2011 | Loban | 206/314 |
| 2011/0259764 | A1 | * | 10/2011 | Sonoda et al. | 206/14 |

OTHER PUBLICATIONS

Incase Dub Bag, author unknown, printed Aug. 7, 2009, 7 pages from website with URL http.//www.goincase.com/products/detail/dub-bag-cl56066.

Attitude Double Guitar Bag GAV-EG30, author unknown, printed Aug. 7, 2009, 2 pages from website with URL http://www.rondomusic.com/gaveg30.html.

Undercover Double Gig Bags, author unknown, printed Aug. 7, 2009, 5 pages from website with URL http://www.bassexchange.com/catalog/index.php?cPath=38_159.

IKA double guitar case, author unknown, printed Aug. 7, 2009, 2 pages from website with URL http://www.ika.zrns.cz/img-new/guitdb.jpg.

Incase Dub Bag, author unknown, printed Apr. 11, 2009, 2 pages from website with URL http://www.goincase.com/products/detail/dub-bag-cl56066.

Gator Double Bass Guitar Slinger Gig Bag (G-Sling-2X-Bass), author unknown, printed Aug. 7, 2009, 1 page from website with URL http://www.interstatemusic.com/webapp/wcs/stores/servlet/ProductDisplay?storeId=10051&langId=-1&catalogId=10001&productId=900228619#.

ProTec CF233D—Deluxe Double Bass Guitar Gig Bag, author unknown, printed Aug. 7, 2009, 5 pages from website with URL http://www.casesandmore.com/PRO-TEC-CF233D-PRO1083.html.

Image Allow Cases: double guitar case, author unknown, printed Aug. 7, 2009, 1 page from website with URL http://www.imagealloycases.com.au/alum_av2.html?pid=23.

Mono, Wingman Case; Daniel Kushner, admitted prior art, 2 pages from website with URL http://www.monocase.com/store/pc/Wingman-Acoustic-Guitar-Case-Dreadnought-5p9.htm.

Mono, Wingman Case; Daniel Kushner, admitted prior art, 3 pages from website with URL http://www.monocase.com/mono-electric-guitar.asp.

Taobao, Soldier Case; author unknown, printed Nov. 30, 2010, 12 pages from unknown website URL.

Access, Stage Five Case; author unknown, date unknown, 2 pages from website with URL http://www.accessbagsandcases.com/gallery4.htm.

Suhr, Deluxe Case; author unknown, date unknown, 3 pages from website with URL http://www.suhrguitars.com/store.html.

Igig, G515 Case; author unknown, date unknown, 4 pages from website with URL http://www.mikobass.com/iGig/G515.htm.

Reunion Blues Continental Case; author unknown, date unknown, 3 pages from website with URL http://www.musiciansfriend.com/accessories/reunion-blues-rb-continental-electric-guitar-case.

Levy's Leather, Cps7 Case; author unknown, dated 2009, 3 pages from website with URL http://www.levysleathers.com/browse;cat,780;Pro-Series-Gig-Bags.

Fusion, F1 Dreadnaught Case; author unknown, printed Mar. 25, 2011, 2 pages from website with URL http://www.fusion-bags.com/products-in-guitar-gig-bags/f1-acoustic-dreadnought-guitar-orange-16119.

Images of guitar case, admitted prior art, author unknown, 2 pages from website with URL http://orgs.usd.edu/nmm/PluckedStrings/Guitars/Gibson/10075/StyleOGuitar.html.

Miscellaneous images of shoes and/or sneakers, admitted prior art, authors unknown, 4 pages.

PCT Application PCT/US12/00548, International Search Report . . . and Written Opinion of the International Searching Authority, mailed Mar. 7, 2013; 8 pages total.

* cited by examiner

MUSICAL INSTRUMENT CASE WITH PROTECTIVE BOOT

CROSS REFERENCE TO RELATED CASES

This application claims the benefit under 35 U.S.C. 119(e) of the following U.S. Applications: U.S. Application Ser. No. 61/557,896 filed Nov. 9, 2011 and entitled "Upright Access Of Hybrid Cases For Protecting Musical Instruments"; U.S. Application Ser. No. 61/587,896 filed Jan. 18, 2012 entitled "Musical Instrument Neck Support In Hybrid Cases"; and U.S. Application Ser. No. 61/587,363, filed Jan. 17, 2012 and entitled "Upright Access Of Hybrid Cases For Protecting Musical Instruments"; which applications are all hereby incorporated by reference in their entirety.

BACKGROUND OF THE INVENTION

1. Field of the Invention

The present invention is directed to cases for the protection of musical instruments. More particularly, the invention relates to cases that provide enhanced protection for the instruments received therein. Accordingly, the general objects of the invention are to provide novel methods and apparatus of such character.

2. Description of the Related Art

The worldwide popularity of instruments such as guitars, keytars, basses, cellos, violins, mandolins, ukuleles, etc. in the last several decades has led to many advances in these instruments as well as related accessories. One such accessory that has seen a wide variety of improvements is the protective case. Such cases are now available in a number of basic styles with a wide variety of materials and features that offer some combination of improved ergonomics, lower cost, lighter weight, and/or better protection. For example, instrument cases are now available in three basic styles (the soft case—or gig-bag—, the hard-shell case and the hybrid case). Cases for protecting individual instruments are now widely available in all of these three styles.

Conventional cases of the type noted-above very typically include a body with a sidewall to receive the instrument and a corresponding cover that is hingedly affixed to the sidewall. Such covers may be releaseably mated with the body with latches, zippers, hook and loop fasteners, etc. and hinged such that the entire body/sidewall is exposed when the cover is in an opened position. Such cases are intended to be laid flat on a horizontal surface before opening the case to insert and/or remove an instrument.

In one variation, some cases for stringed musical instruments (particularly guitars) have been made with a releasable and resealable opening in the sidewall at the butt-end (the lower bout) of the instrument. Thus, these cases do not have a cover that is hingedly affixed to the sidewall since the sidewall itself provides the means of accessing the interior of the case. These cases are designed for use with instruments that have an elongated neck that is attached to an enlarged body and designed to be laid flat on a horizontal surface before opening the case to insert and/or remove an instrument. In use, an instrument is inserted into the case neck-first by handling the body and removed from the case body-first by handling the body.

It is therefore, a primary object of the present invention to provide improvements in carrying cases for stringed musical instruments which overcome the disadvantages associated with earlier types of cases.

SUMMARY OF THE INVENTION

The present invention satisfies the above-stated needs and overcomes the above-stated and other deficiencies of the related art by providing cases for the protection of musical instruments, each with a neck and a body. The case includes a case body having an elongated upper portion for receiving the instrument neck and a lower enveloping portion, with a far end, for receiving the instrument body. The cases also include a selectively releasable cover hingedly affixed to the case body to permit selective access to the case body so that the instrument may be inserted into and removed from the case. The cases also include a protective boot attached to the far end of the case body. Optionally, such boots may include a central region disposed between a pair of opposing regions wherein the central region transfers less shock to the stringed instrument body than the opposing regions.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1A:
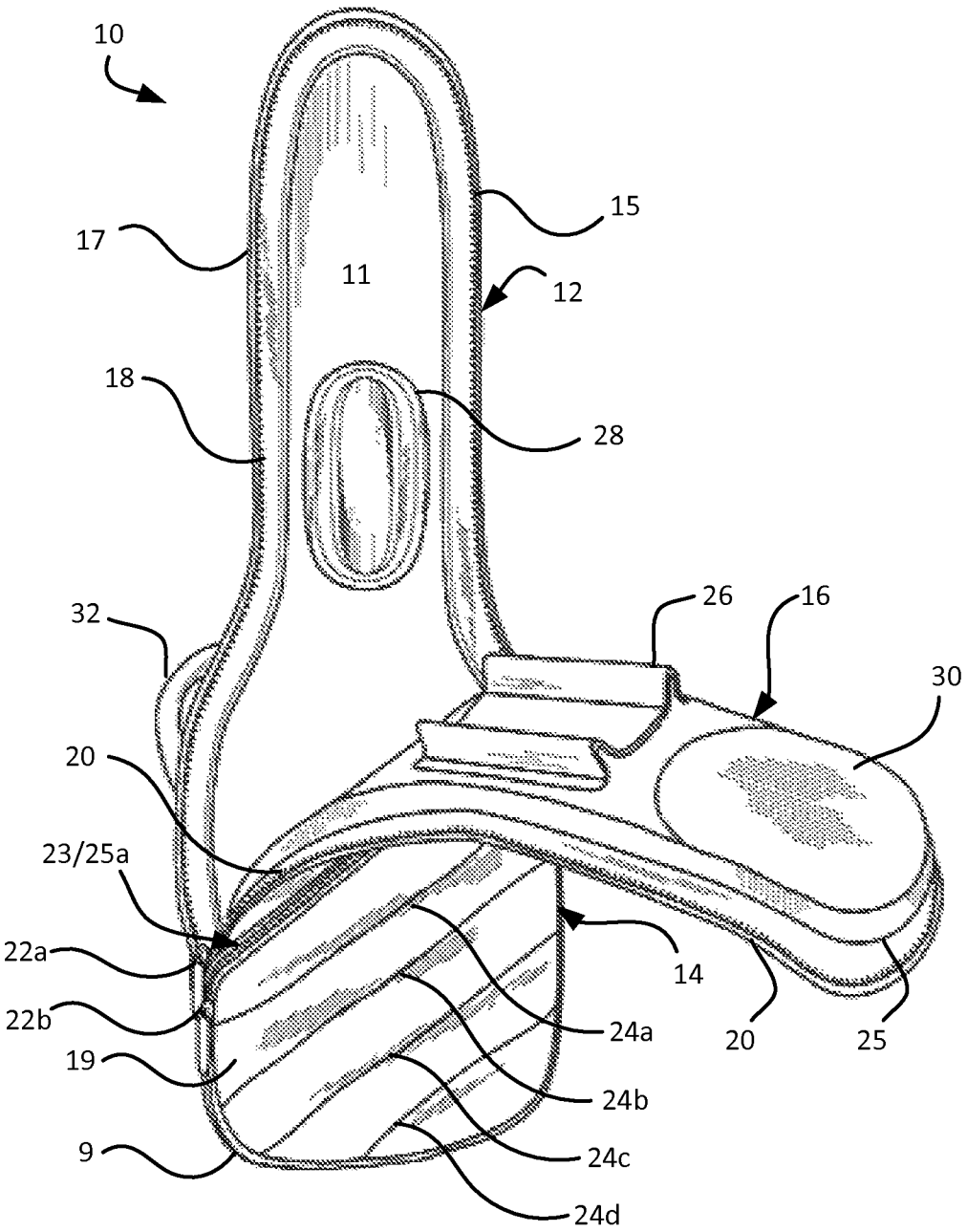
FIG. 1A is a front elevation view of a protective hybrid case in accordance with one preferred embodiment of the present invention shown in an opened condition.
Figure 1B:
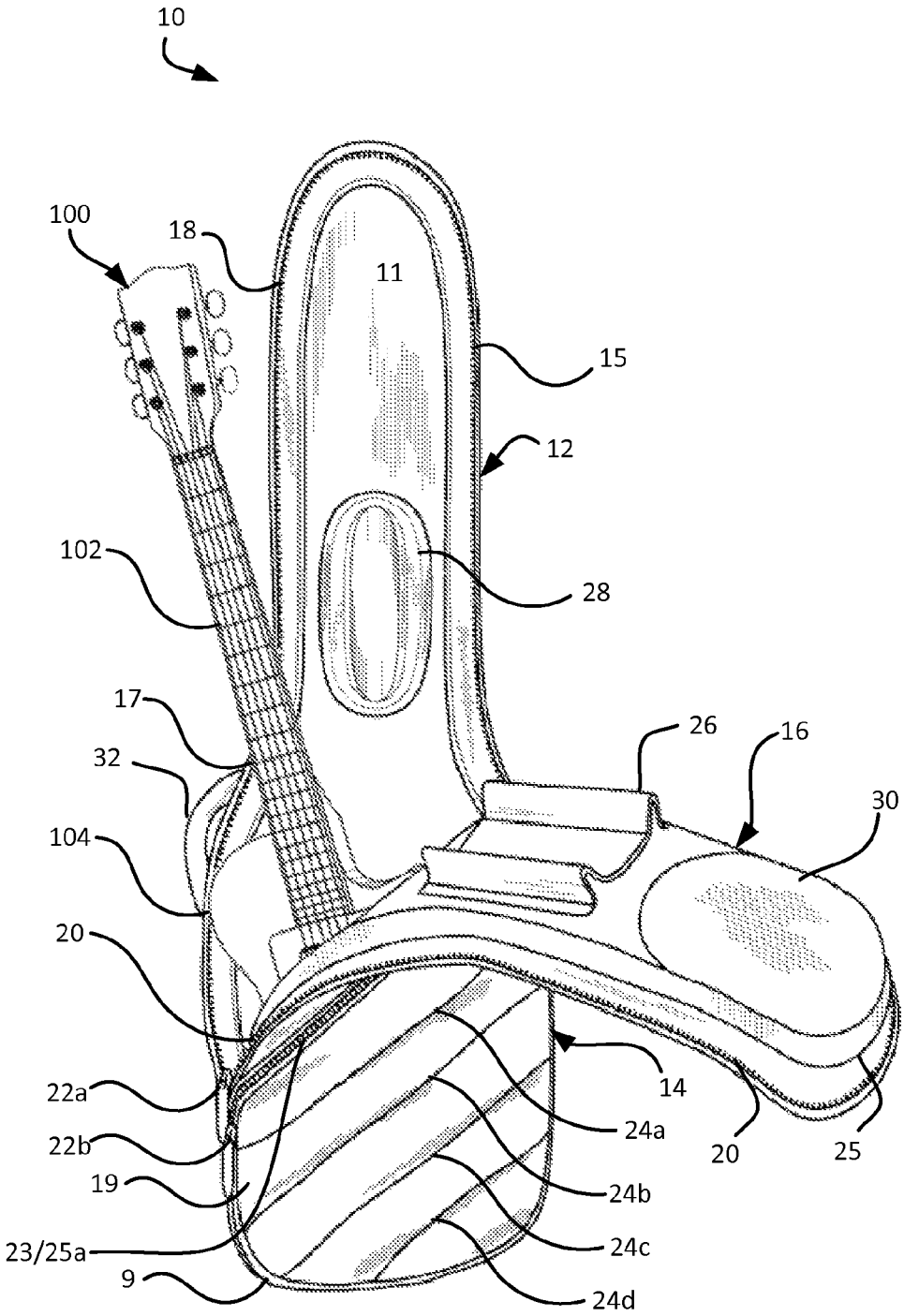
FIG. 1B illustrates the hybrid case of FIG. 1A with an instrument in the process of being inserted into or being removed from the case.
Figure 1C:
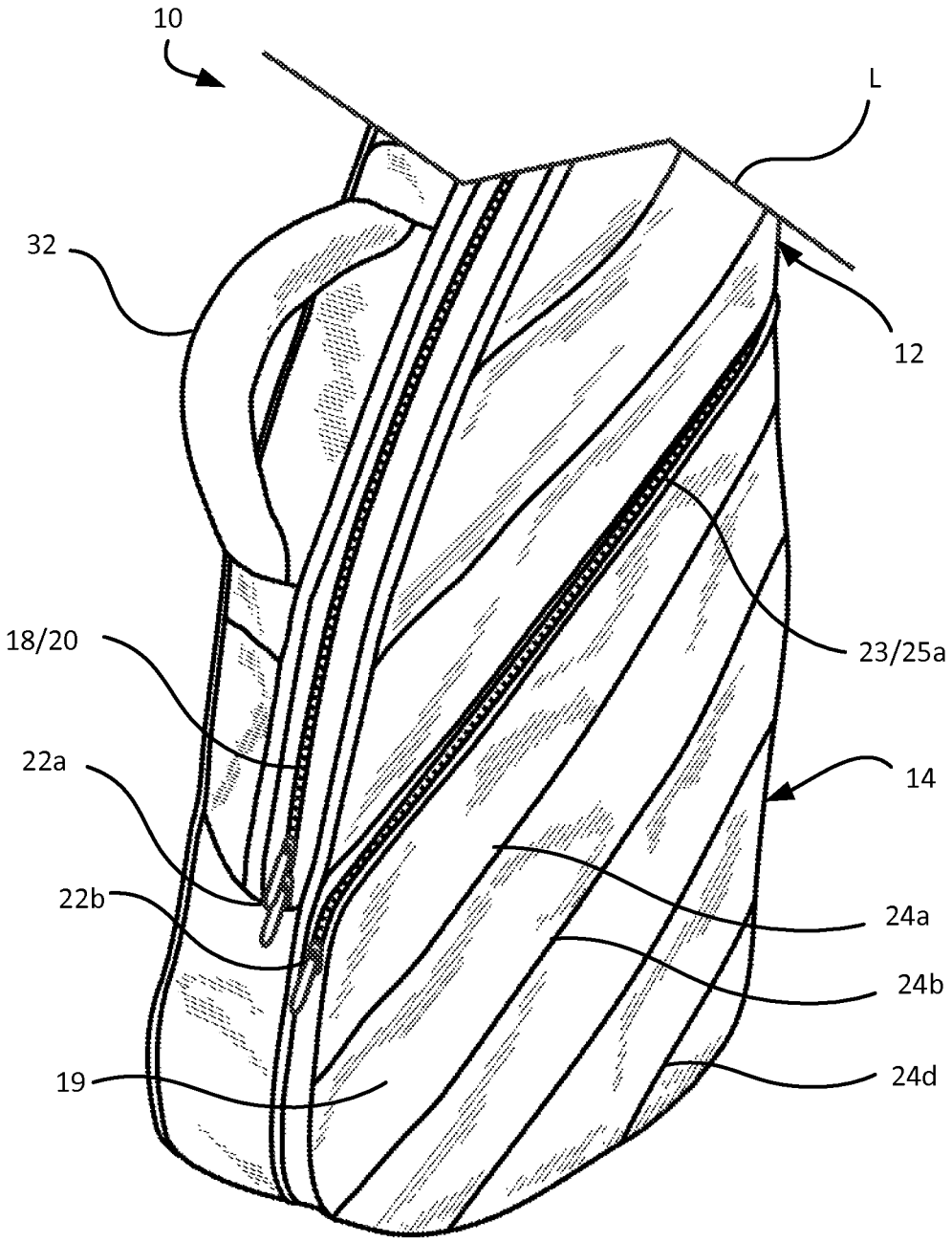
FIG. 1C is a perspective view of the lower portion of the hybrid case of FIGS. 1A and 1B, wherein the front cover of the case has been closed.

With joint reference to FIG. 1A through FIG. 1C, there is shown therein a first preferred embodiment of the protective instrument case 10 of the present invention. By way of example only, the invention is shown and described therein with reference to an electric guitar 100. However, the protective cases according to all of the various Figures can be used not only for guitars but also for holding other musical instruments such as electric, electronic and/or acoustic instruments such as, e.g., double bass, cello, violin, keytar, bass-guitar, ukulele, etc. provided that the dimensions and overall shape are appropriate or modified accordingly. As shown, guitar 100 includes an elongated neck 102 with a head at one free end thereof and affixed to an enlarged body 104 at an upper bout, body 104 also having a lower bout (not shown) at the far bottom end thereof.

As shown, case 10 preferably has a body with upper access 12 and lower enveloping 14 portions for receiving the instrument 100. The body may have a semi-rigid, continuous sidewall defining a continuous front edge 18 with a first elongated side 15 in the upper access portion 12, a second elongated side 17 in the upper access portion 12 (and partially extending into the lower enveloping portion 14), and a bottom portion 9 extending along the lower enveloping portion 14 of the body between the first and second sides 15 and 17. The sidewall further defines a back edge that forms a continuous perimeter, wherein the front and back edges are spaced apart from one another. The case 10 also has a semi-rigid back 11 fixedly attached to the back edge of the sidewall. A front cover 16 is releaseably fastened to the sidewall along the first and second elongated sides 15 and 17 and fixedly attached along the bottom portion 9 of the sidewall between the first and second elongated sides. The releasable fastener may be any one or more of a zipper 18 and 20 (preferred), a hook and loop fastener, snap fasteners and many other conventional releasable fasteners known in the art. The front cover 16 further comprises a (preferably diagonal) hinge 25*a* whereby the cover will split open along the hinge 25*a* (preferably across cover 16 between the first and second sides 15 and 17) when the front cover 16 is released from the sidewall. This may occur with the case is in the upright orientation (as shown in all of the Figures). A conventional handle 32 may be provided as is known in the art. It will be appreciated that many stringed musical instruments such as guitars, bases, ukuleles, etc. include bodies with an upper bout a lower bout and a "pinched off" waist therebetween. With such instruments it is preferred that the lower enveloping portion 14 of the inventive cases restrain at least a substantial portion of the lower bout of the instrument to be carried therein; this configuration virtually guarantees that an instrument placed therein cannot slip out of the bottom end of the case and be damaged. This is a significant advantage over conventional cases in which a zipper is provided along the full length of the bottom of the case because it is relatively easy for an instrument to slip out of such a case if one were to try to place an instrument in such a case in an upright orientation. This is especially true for gigging musicians that often need to quickly pack up their gear after gigs and who may be under the influence of mind altering substances.

The case of FIGS. 1A-1C may include a storage compartment 19 fixedly attached along the bottom portion 9 of the front edge of the sidewall between the first and second elongated sides 15 and 17 and releaseably fastened (preferably with zipper 23 and draw pull 22*b*) along a diagonal line between the first and second elongated sides 15 and 17. In this preferred embodiment this line is also at least generally coincident with the hinge means 25*a* wherein the hinge is presently hidden from view within cover 16 and behind zipper 23. As can be seen, case 10 preferably includes plural parallel "puff-pattern" seam lines (see e.g., 24*a*, 24*b*, 24*c* and 24*d*) stitched in the padded cover 16 and back 11. It will be appreciated that the hinge means 25*a* may comprises a weakened diagonal "puff-pattern" seam line extending across the cover 16 between the first and second elongated sides 15 and 17 and located at the far ends of the releasable fastener (zipper 18/20 with draw pull 22*a* in the embodiment shown here). Alternatively, the cover 16 may be at least partially formed of two pieces of semi-rigid material (within outer fabric of cover 16) and the hinge means 25*a* may comprise an interface between adjacent edges of the two pieces of semi-rigid material. More generally, the hinge means 25*a* may comprise an elongated weakened region in the semi-rigid material (or simply flexible fabric) extending across the cover 16 between the first and second elongated sides 15 and 17. Hinge means 25*a* may also comprise one of the many conventional mechanical hinge types well-known in the mechanical arts alone or in combination with other types of hinges described herein.

The case of FIGS. 1A-1C may optionally also include a preferred two-part neck brace 26/28 to reliably and firmly grasp neck 102 of instrument 100 when cover 16 is fastened to the front sidewall edge via zipper 18/20 when closed. Other neck brace structures may also be used as an alternative; these include those shown and described in U.S. Pat. No. 7,872,187 issued Jan. 18, 2011 and entitled Hybrid Cases For The Protection Of Up To Two Stringed Musical Instruments; and U.S. Pat. No. 7,687,701 and issued on Mar. 30, 2010 and entitled Cases For The Protection Of Stringed Musical Instruments, both of which patents are hereby incorporated by reference in their entirety. A pad or patch 30 of durable material may be located near the top end of cover 16 to protect the cover from hard and/or sharp components typically found on a stringed instrument (sharp string ends, machine heads, etc.).

Figure 1D:
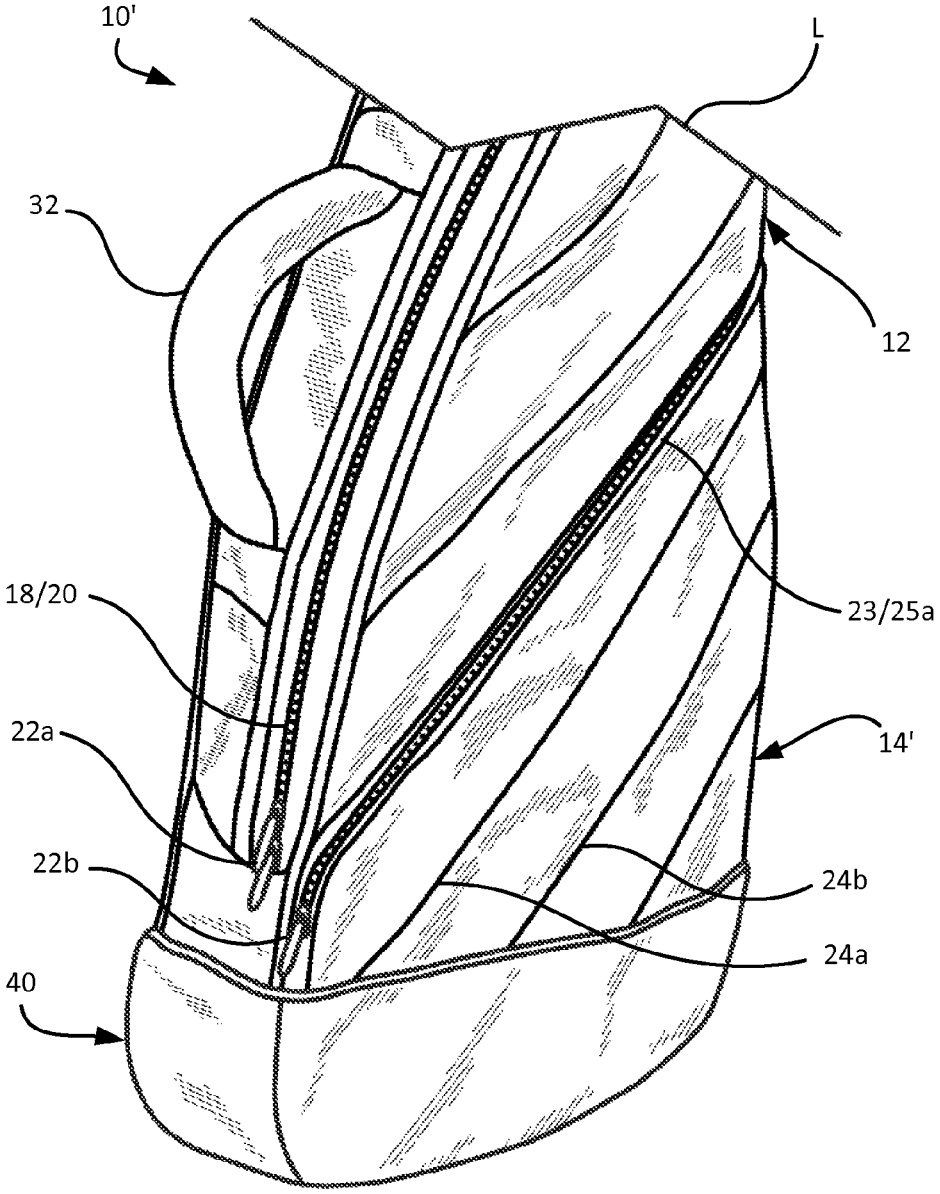
FIG. 1D is a perspective view of the lower portion of a variant embodiment of a hybrid case similar to that shown in FIGS. 1A, 1B and 1C, wherein the butt-end of the case includes a unitary and water-proof protective boot.
Figure 1E:
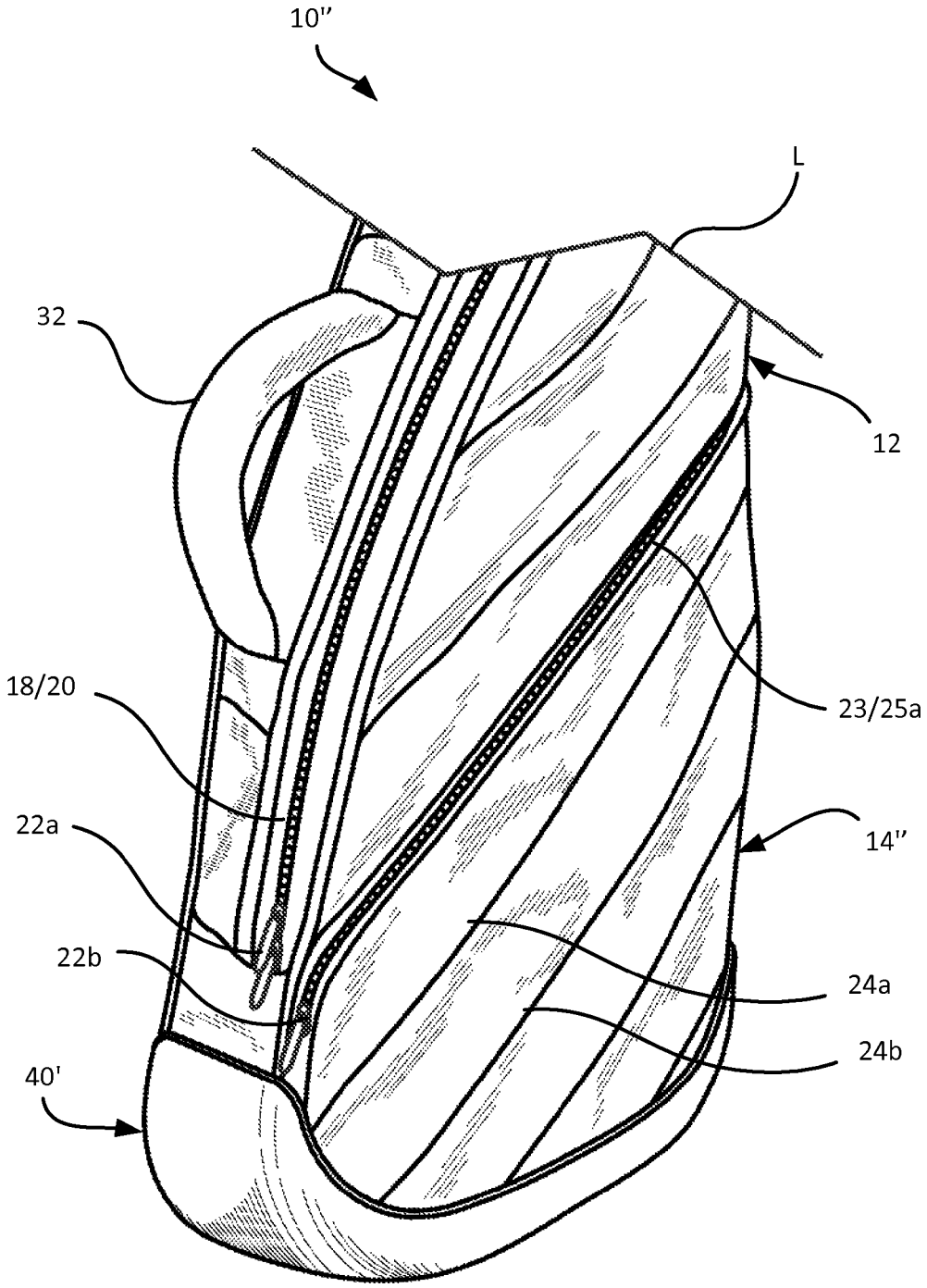
FIG. 1E is a perspective view of the lower portion of another variant embodiment of a hybrid case similar to that shown in FIGS. 1A, 1B and 1C wherein the butt-end of the case includes another style of unitary protective boot.
Figure 2:
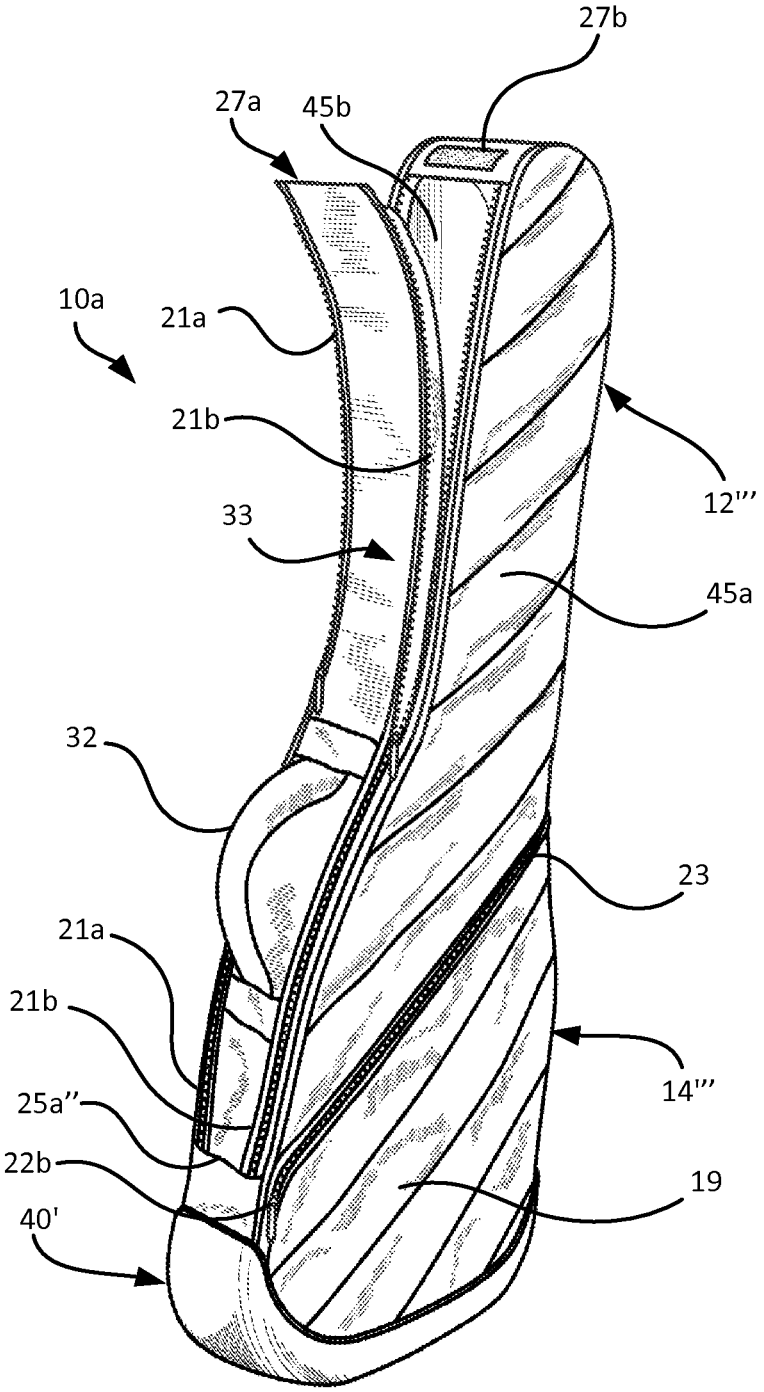
FIG. 2 is a perspective view of another embodiment of a hybrid case in accordance with the invention wherein the interior of the case may be accessed through a portion of the sidewall in the neck region of the case.

Turning now to FIGS. 1D, 1E and 2, an optional feature of the present invention may include means for water-proofing 40 and 40' an exterior surface of at least part of the lower enveloping portion 14, 14' and 14" of the case body whereby the case body will not leak when the case is placed in the upright orientation and into a pool of liquid. As shown, the means for water-proofing 40 and 40' may comprise a unitary boot of water-proof material fixedly attached to the far end of the lower enveloping portion 14 of the case body such that a seamless surface covers at least the lowest part of the lower enveloping portion of the case body. The boot is preferably sewn onto the outer fabric of the case along the top edge of the boot 40'. In addition, or alternatively, the boot may be glued onto the lower portion of case 10, 10' and/or 10". Most preferably the boot 40 and 40' will further comprises a central region 52 disposed between a pair of opposing regions 54*a* and 54*b* and wherein the central region 52 comprises means for absorbing shock more readily than the opposing regions. This may take the form of a recess or aperture (e.g., 52') located in the central region to slightly weaken the inherent properties of the boot material in solid form. The opposing regions may also be thicker than the central region to absorb shock. These aforementioned structures are particularly advantageous in that they accommodate the strap button typically extending from the lowest part of a stringed musical instrument 100. Among other things, by addressing this delicate matter in the boot 40 and 40', the rest of case 10 may take a simpler and less expensive form without sacrificing any level of instrument protection. Finally, water-proofing may alternatively also include simply applying a coating of water-proof material such as by painting it on or by means of a spray application (see 40 of FIG. 1D).

Those of ordinary skill will naturally appreciate that FIG. 1D is broken along line L for simplicity. It is otherwise the same as case 10 of FIGS. 1A and 1B. Similarly, cases 10' and 10" of FIGS. 1D and E are broken along line L since the elongated access portion of these cases is the same as those shown in FIGS. 1A and 1B, with the primary difference residing in the structure of boot 40 and 40'.

Figure 4:
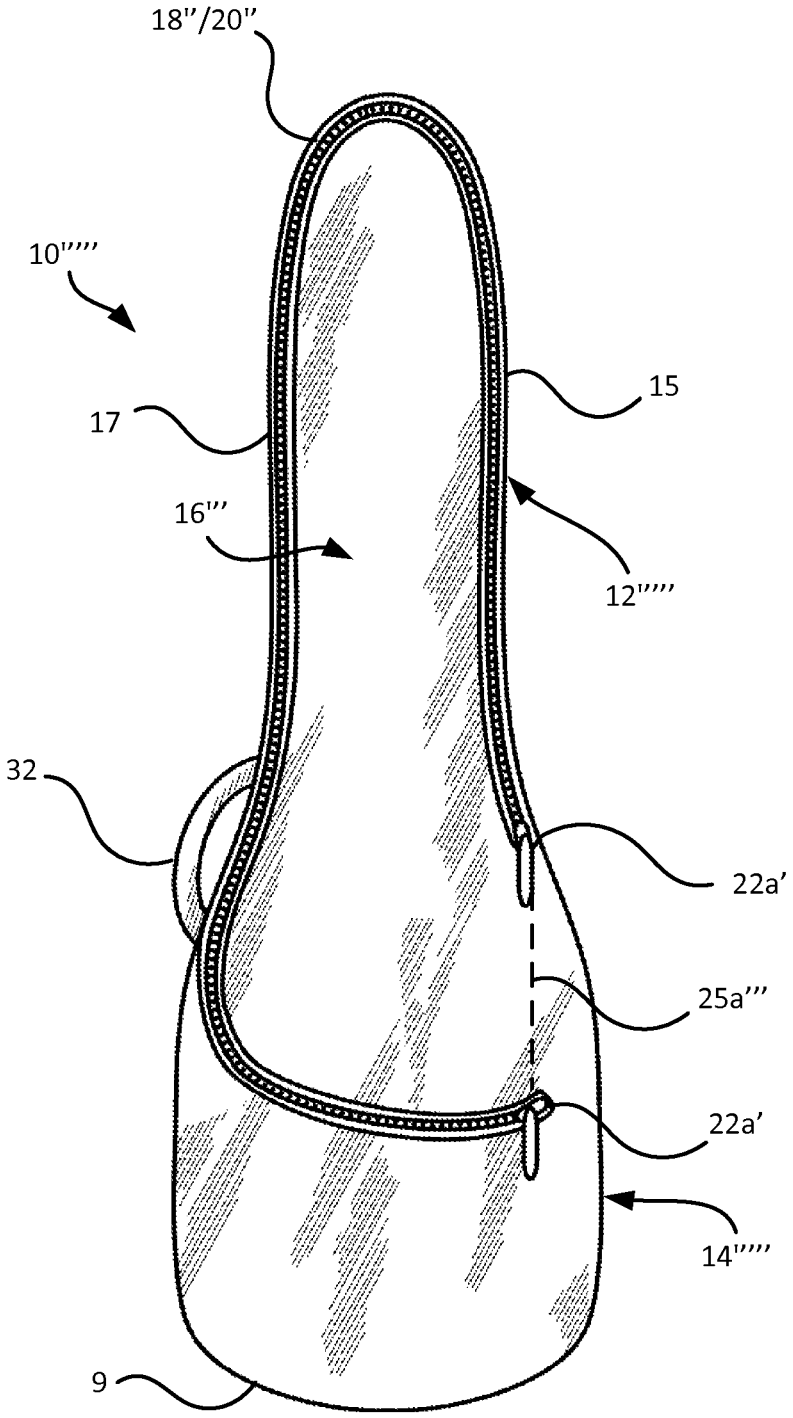
FIG. 4 is a front elevation view of another embodiment of a hybrid case in accordance with the invention wherein the interior of the case may be accessed through a cover in the neck region of the case.

Turning now to the embodiment of FIG. 4, as indicated by the use of like reference numerals, there is shown therein case 10' of the same general structure as that of case 10 shown in FIGS. 1A, 1B and 1C. Case 10"" primarily differs from that of case 10 in the shape and structure of releasable fastener 18"/20", cover 16"', upper access portion 12"" and lower envelope portion 14"". However, case 10' is importantly different in the location, orientation, structure and shape of hinge means 25*a*'".

Turning to FIG. 2 there is shown therein an alternative embodiment of the invention in which the means for accessing the interior of case 10*a* is through sidewall 33. An inventive case in accordance with FIG. 2, may include a body having an elongated upper access portion 12"' for receiving the instrument neck and a lower enveloping portion 14"' for receiving the instrument body. The body may comprise (1) a generally planar and semi-rigid back 45*b* defining a continuous back perimeter; (2) a generally planar and semi-rigid front 45*a* spaced apart from the semi-rigid back 45*b* and defining a continuous front perimeter; and (3) a semi-rigid sidewall 33 fixedly attached to the front and back 45*a* and 45*b* along the lower enveloping portion and fixedly attached to the front and back along a portion of the upper access portion. In this embodiment the sidewall also preferably releaseably fastened to the front and back 45*a* and 45*b* along another part of the upper access portion with zipper 21*a* and 21*b* or another known releasable fastener. One far end 27*a* of sidewall 33 may include half of a releasable fastener and the opposing half fastener 27*b* may be disposed on another portion of the sidewall. Hook and loop fasteners are preferred for this application. Case 10*a* may also include hinge means 25*a*" extending across the sidewall 33 whereby the portion of the sidewall 33 will tend to open along the hinge means 25*a*" when the sidewall 33 is released from the front and back 45*a* and 45*b* (note that the case may be in the upright orientation).

Figure 3:
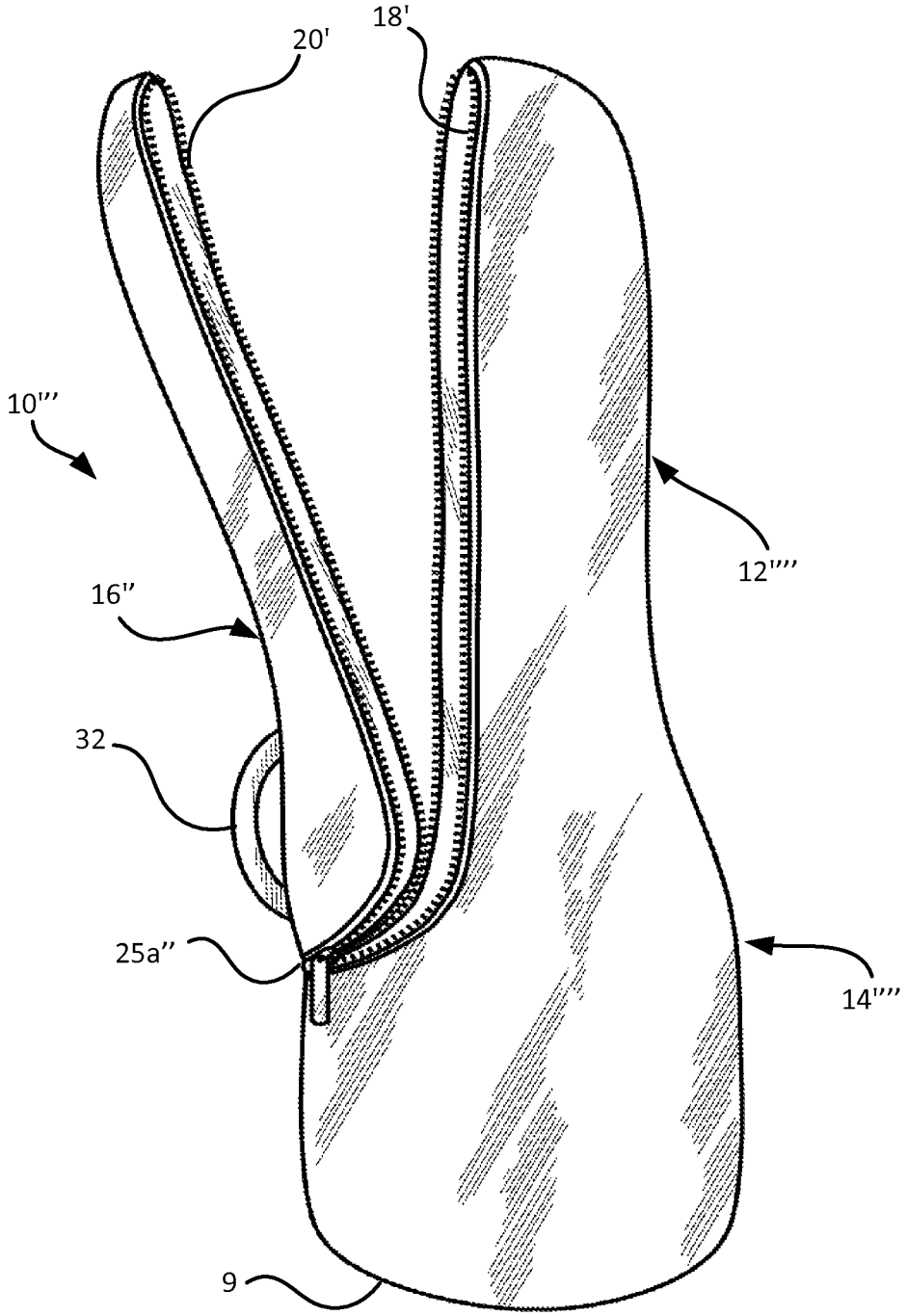
FIG. 3 is a front elevation view of another embodiment of a hybrid case in accordance with the invention wherein the interior of the case may be accessed through a cover in the neck region of the case.

Still another embodiment of the invention is shown in case 10"' of FIG. 3. Case 10"' features upper access portion 12"", lower envelope portion 14"" and a modified cover/sidewall structure 16" to access the interior of case 10"'. This structure preferably uses modified releasable fastener 18'/20' that spans across the elongated upper access portion of case 10"'. As a result, the hinge means 25*a*" lies substantially across the sidewall of case 10"' rather than across the face of the case.

It will be appreciated that cases in accordance with the invention are specifically intended to be oriented upright during insertion of and/or removal of instruments. In musical instruments with elongated necks, it naturally follows that the instrument is preferably grasped on the neck when inserting or removing the instrument. This implies that an instrument body will enter an inventive case before an instrument neck. Conversely, an instrument neck will be removed from an inventive case before an instrument body. This arrangement minimizes the possibility that an instrument with tuners on a headstock thereof might be inadvertently knocked out of tune because the headstock is essentially simply placed into an inventive case (rather slid into and out a case as might occur with a poorly designed case).

It will also be appreciated that cases in accordance with the invention may be configured to accommodate multiple instruments similar to those shown and described in U.S. Pat. No. 7,872,187 issued Jan. 18, 2011 and entitled Hybrid Cases For The Protection Of Up To Two Stringed Musical Instruments; but with such cases modified in accordance with the invention shown and described herein. Such modifications may be accomplished using ordinary skill in the art based on the disclosure/teachings contained herein.

Turning now to FIGS. 5A-5D, a preferred form of the optional boot 50. In one optional form, boot 50 may provide a means for water-proofing the case because the boot may prevent liquid from entering the far end of the lower enveloping portion of the case body when the case is placed on a surface in the upright orientation even if the surface contains a pool of liquid. It is also contemplated that some boot embodiments may not be waterproof. However, boot 50 may also provide improved shock absorption in the vicinity of the lower enveloping portion of the case compared with bootless embodiments of hybrid cases. Thus, in light of this disclosure, various boots that provide different levels of waterproofing and/or shock absorption may be attained. In one form (FIG. 5A-5C), boot 50 may comprise an exterior outsole 50*a* (preferably of rigid or semi-rigid and of water-proof material) and an interior insole 50*b* that may be fixedly attached (such as by gluing or other known means of affixation) within an interior recess or well 50*a*' of outsole 50*a*. Either or both of insole 50*b* and outsole 50*a* may be comprised of one or more of various rubberized plastics, polyolefin, EVA, polyethylene compounds, polyurethane compounds, and other conventional materials in the art that may be formed using known methods such as through injection molding and/or other conventional methods in the art. However, insole 50*b* is preferably formed of a material that is less rigid (more resilient) than outsole 50*a*. Also, this two piece configuration allows case designers to select insole and outsole materials that optimize instrument protection (e.g., insole 50*b* may be covered in a soft fabric that is unlikely to scratch an instrument finish). Outsole 50*a* may be fixedly attached to the lower enveloping portion of any of the cases shown herein such that a seamless exterior surface covers the far end of the case body. The boot 50 is preferably sewn onto the outer fabric of a hybrid case along the top edge of outsole 50*a*. Since boot 50 preferably encloses the entire bottom end of the case, the bottom end of the case body to which the boot is fixedly attached may be open so that the instrument body rests directly onto the interior surface of boot 50. In such embodiments, the boot 50 must be firmly affixed to the open-ended case body to prevent the instrument from falling out of the bottom of the case in use. In addition, or alternatively, the boot may be glued onto the lower portion of case 10, 10' and/or 10". In the more economical, but otherwise less favored alternative embodiment of FIG. 5D, boot 50' may be formed as a single, integrally-formed piece with a strap button recess 52'.

Figure 5A:
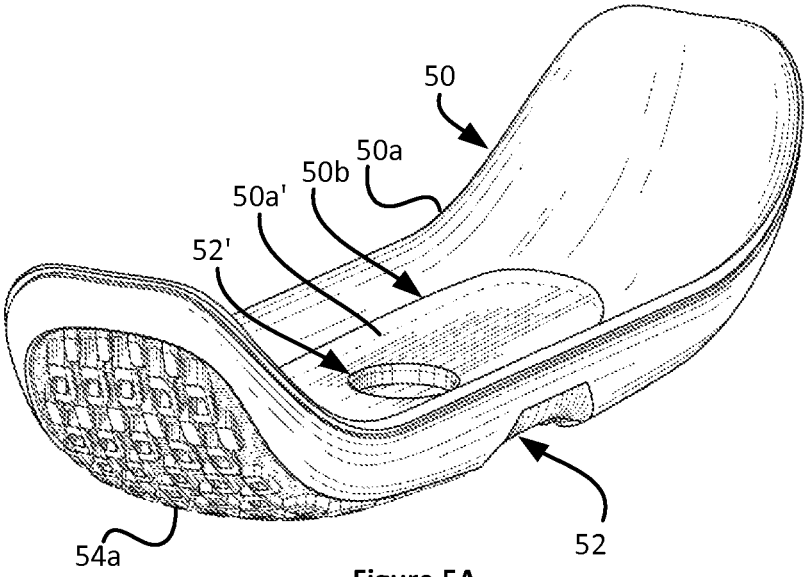
FIGS. 5A-5C show various views of a preferred protective boot similar to those depicted in FIGS. 1E and 2.
Figure 5B:
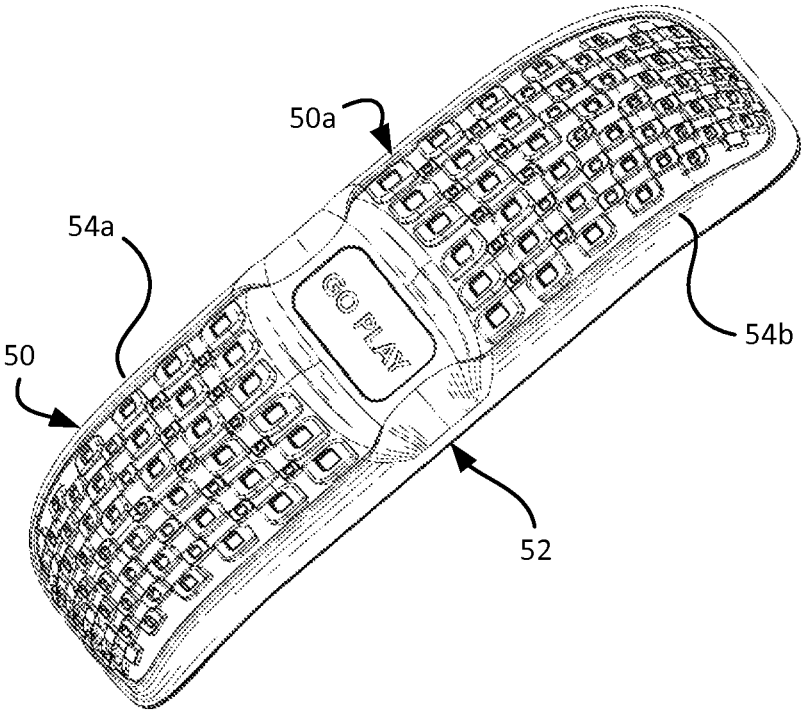
Figure 5C:
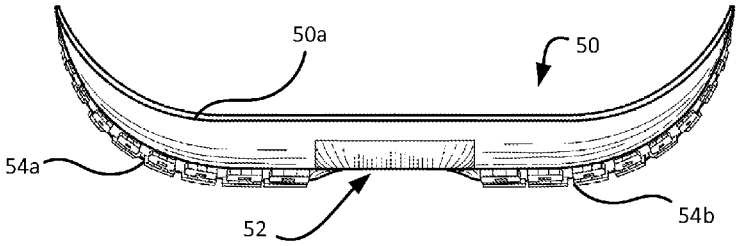
Figure 5D:
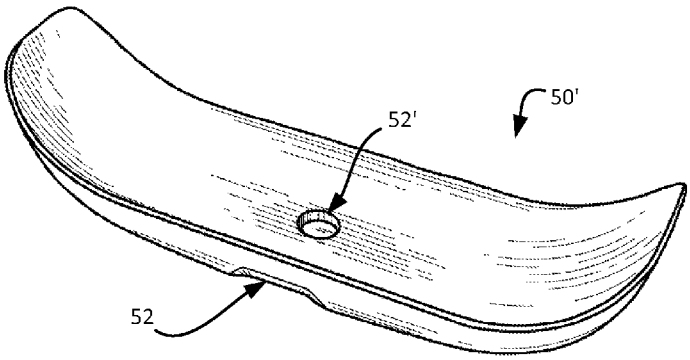
FIG. 5D shows an alternative, integrally-formed protective boot similar to those depicted in FIGS. 5A-5C FIGS. 5E and 5F show another alternative protective boot embodiment similar to those depicted in FIGS. 5A-5C.

As best seen in FIGS. 5A-5C, the exterior surface of outsole 50*a* may include a tread configuration or other irregular surface to reduce slippage between the case and a surface on which the case may be placed. Also shown in these Figures is the fact that the exterior surface of outsole 50*a* is preferably at least generally convex and, most preferably, convex in two perpendicular directions. This concavity is intended to make the case substantially unstable in an upright position on its own which will, in turn, greatly reduce the likelihood that a user might try to leave the case unattended in an upright position. As discussed in this and prior disclosures of this inventor, even well-designed cases that fall from an upright position can lead to instrument damage. The convex exterior surface of the outsole, therefore, provides an unexpected level of protection because it reduces the likelihood that inventive cases will be left unattended in an upright position.

Most preferably, the outsole 50*a* will further comprises a central region 52 disposed between a pair of opposing regions 54*a* and 54*b* wherein the central region 52 may comprise means for transferring less shock (e.g., absorbing or distributing shock) to the instrument than the opposing regions 54*a* and 54*b*. This may take the form of a recess or aperture 52', etc. located in the interior of boot 50 and/or the form of a slightly weakened and/or recessed central region on the exterior of boot 50 (for example, by reducing the boot thickness in the central region 52). As known in the art, stringed instrument bodies may include a far end (the lower bout) with a (often centered) strap button extending therefrom. In one aspect of the invention, the means for transferring less shock to the instrument may comprise at least one recess 52' sized, shaped and positioned (e.g., by being aligned with the central region of the boot) to at least partially receive the instrument strap button therein (as is conventional and known in the art). The use of two additional recesses 52' will also accommodate instruments (such as Tom Anderson guitars) that employ two offset strap buttons on the lower bout thereof and three recesses may be sufficient to accommodate all styles of guitars discussed above. Further, the opposing regions 54*a* and 54*b* may also be thicker than the outer central region 52 to achieve the same effect in a different way. Alternatively, the means (of the central region 52) for transferring less shock to the instrument may incorporate deformation structures and/or materials intended to absorb shock more readily than the opposing regions. These aforementioned structures are advantageous in that they accommodate the strap button typically extending from the lowest part of a stringed musical instrument 100. Among other things, addressing this delicate matter in the boot 50, enables the rest of case 10 to take a simpler and less expensive form without sacrificing any level of instrument protection.

Those of ordinary skill will readily appreciate that the exterior boot aspect of the present invention may also be readily applied to hybrid cases designed to accommodate multiple instruments simultaneously (such as those taught in U.S. Pat. No. 7,872,187 issued Jan. 18, 2011 and entitled Hybrid Cases For The Protection Of Up To Two Stringed Musical Instruments) with such cases modified in accordance with the invention shown and described herein. Such modifications may be accomplished using ordinary skill in the art based on the disclosure/teachings contained herein.

Figure 5E:
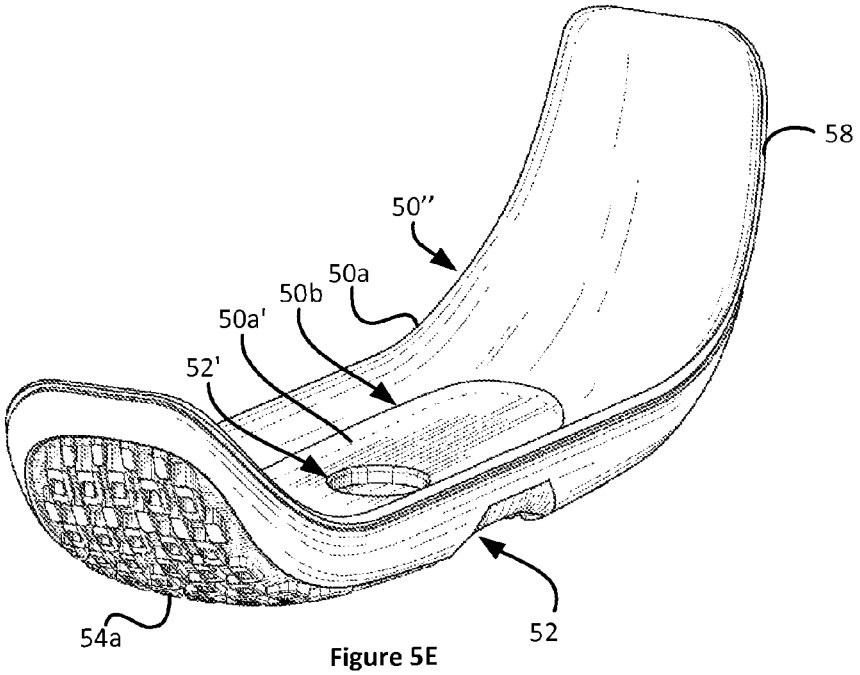
FIGS. 5G and 5H show still another alternative protective boot embodiment similar to those depicted in FIGS. 5A-5C.
Figure 5F:
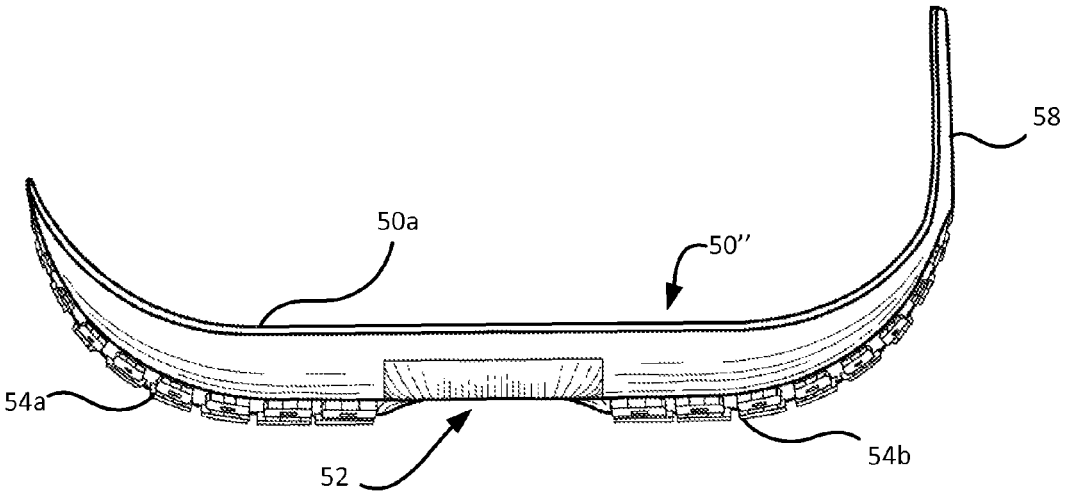

FIGS. 5E and 5F show another alternative protective boot embodiment similar to those depicted in FIGS. 5A-5C. In this embodiment, outsole 50" includes one integrally-formed extended side 58 that extends along the sidewall of the case to which the boot is affixed. The purpose of extended side 58 is twofold. First, it provides lateral support to the sidewall of the case so that the case will be stable when rested on edge (with the sidewall opposite the handle placed on the ground). Second, it protects the sidewall of the case when it is rested on edge (since the case will rest on the durable outsole rather than the less durable fabric portion of the sidewall). Extended side 58 is preferably sized and shaped to mate with the lower sidewall of the case to which it is affixed.

Figure 5G:
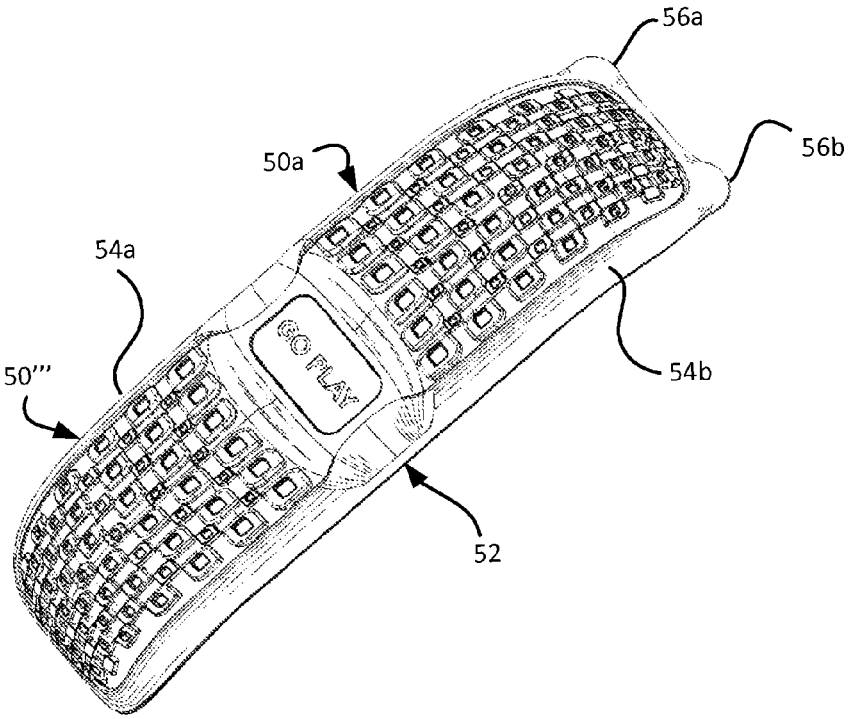
Figure 5H:
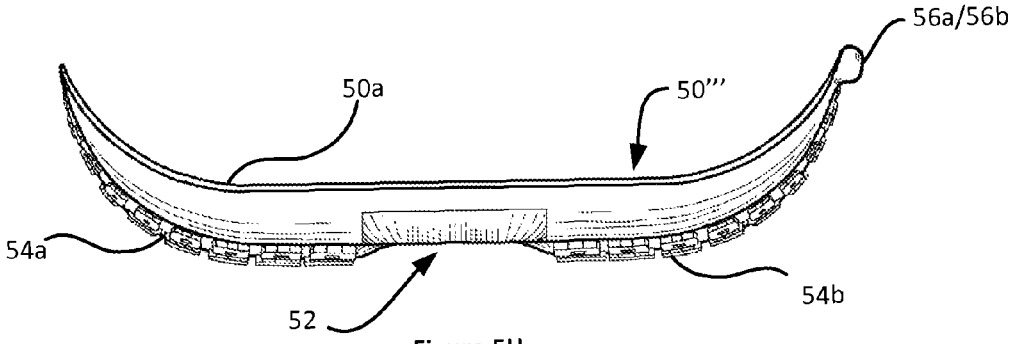

FIGS. 5G and 5H show still another alternative protective boot embodiment similar to those depicted in FIGS. 5A-5C. In this embodiment, outsole 50'" includes a pair of integrally-formed opposing nubs 56*a*/56*b* that extend from the far end of outsole 50'". The purpose of nubs 56*a*/56*b* is twofold. First. it provides lateral support to the sidewall of the case so that the case will be stable when rested on edge (with the sidewall opposite the handle placed on the ground). Second, it protects the sidewall of the case when it is rested on edge (since the case will rest on the durable nubs 56*a*/56*b* rather than the less durable fabric portion of the sidewall). Nubs 56*a*/56*b* could also be incorporated into extended side 58 of FIGS. 5E and 5F if desired.

As used herein, "fixedly attached" generally means permanently attached and not intended to be detached and reattached; separating "fixedly attached" components will likely cause damage (such as tearing, ripping, breaking, cutting, etc.) to at least one of the components. Further, as used herein, the terms "fixedly attached" and "releaseably fastened" are intended to be mutually exclusive.

As used herein, "upright orientation" generally means at least generally vertical and/or at least generally perpendicular to a floor/the ground/or similar generally-horizontal surface. With respect to an instrument case, "upright orientation" may additionally mean an orientation in which a far end of the case body may be at least generally adjacent to, on, and/or touching a floor/the ground/or similar generally-horizontal surface. With respect to a stringed instrument, "upright orientation" may mean an orientation in which the instrument neck and headstock are at least generally vertically above the instrument body.

As used herein, "flexible" generally means capable of substantial deformation without a tendency to break and without a natural tendency to return to its original form. Examples of some flexible shell materials include woven cottons, nylon, cordura, vinyl and other natural or synthetic textiles.

As used herein, "semi-rigid" generally means capable of substantial deformation without a tendency to break but with a natural tendency to return to its original form Examples of some semi-rigid materials include polyurethane, high density and "memory" foams, as well as foams layered with other natural or synthetic textiles.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

What is claimed is:

1. A case for the protection of at least one musical instrument with an elongated neck and a body in which insertion of and removal of the musical instrument occurs with the case in an upright orientation on a surface, the case comprising:

a case body having an elongated upper access portion for receiving the instrument neck and a lower enveloping portion for receiving the instrument body, wherein a far end of the lower enveloping portion rests on the surface with the case in the upright orientation;

a selectively releasable cover hingedly affixed to the case body to thereby permit selective access to the upper access portion of the case body whereby the musical instrument may be inserted into and removed from the case through the upper access portion with the case in an upright orientation on the surface;

wherein the far end of the lower enveloping portion of the case body further comprises an exterior shock absorbing boot with a water-proof and seamless exterior surface that covers the far end of the lower enveloping portion of the case body; and wherein the exterior surface of the boot includes a tread configuration to reduce slippage between the case and a surface on which the case is placed.

2. The hybrid case of claim 1 wherein the boot comprises an exterior outsole with an interior recess and an insole received within the interior recess, and wherein the outsole is formed of a material that is more rigid than the material from which the insole is formed.

3. The hybrid case of claim 1 wherein the exterior outsole further comprises an exterior surface that is at least generally convex in two perpendicular directions whereby the case is substantially unstable when in an upright orientation on the surface.

4. A case for the protection of at least one stringed musical instrument with an elongated neck and a body that is wider than the elongated neck, the case comprising:

a case body having an elongated upper portion for receiving the stringed instrument neck and a lower enveloping portion with a far end for receiving the stringed instrument body;

a selectively releasable cover hingedly affixed to the case body to thereby permit selective access to the case body whereby the stringed instrument may be inserted into and removed from the case; and an exterior shock absorbing boot fixedly attached to the far end of the case body and having a central region disposed between a pair of opposing regions, wherein the central region transfers less shock to the stringed instrument body than the opposing regions, wherein the boot further comprises an exterior outsole with an interior recess and an insole received within the interior recess, and wherein the outsole is formed of a material that is more rigid than the material from which the insole is formed.

5. The case of claim 4, wherein the exterior surface of the boot includes a tread configuration to reduce slippage between the case and a surface on which the case is placed.

6. A case for the protection of at least one stringed musical instrument with an elongated neck and a body that is wider than the elongated neck, the case comprising:

a case body having an elongated upper portion for receiving the stringed instrument neck and a lower enveloping portion with a far end for receiving the stringed instrument body;

a selectively releasable cover hingedly affixed to the case body to thereby permit selective access to the case body whereby the stringed instrument may be inserted into and removed from the case; and an exterior shock absorbing boot fixedly attached to the far end of the case body and having a central region disposed between a pair of opposing regions, wherein the central region transfers less shock to the stringed instrument body than the opposing regions, and wherein the boot further comprises an exterior surface that is at least generally convex in two perpendicular directions whereby the case is substantially unstable when in an upright orientation.

* * * * *